US007530862B2

(12) United States Patent
Ragnarsson

(10) Patent No.: US 7,530,862 B2
(45) Date of Patent: May 12, 2009

(54) CONTACT FINGER WITH GROOVES

(75) Inventor: Sven-Christer Ragnarsson, Anderstorp (SE)

(73) Assignee: Plastab; Anderstorp AB, Anderstorp (SE)

( * ) Notice: Subject to any disclaimer, the term of this patent is extended or adjusted under 35 U.S.C. 154(b) by 0 days.

(21) Appl. No.: 11/679,310

(22) Filed: Feb. 27, 2007

(65) Prior Publication Data

US 2007/0212951 A1 Sep. 13, 2007

(30) Foreign Application Priority Data

Mar. 9, 2006 (SE) ..... 0600526

(51) Int. Cl.
*H01R 11/22* (2006.01)

(52) U.S. Cl. ..... 439/856

(58) Field of Classification Search ..... 439/790, 439/857, 517, 246, 851, 79, 947, 907, 856
See application file for complete search history.

(56) References Cited

U.S. PATENT DOCUMENTS 4,166,663 A 9/1979 Walker et al.
4,684,191 A * 8/1987 Feher et al. ..... 439/246
4,963,102 A 10/1990 Gettig et al.
5,518,421 A * 5/1996 Davis ..... 439/607
5,618,187 A * 4/1997 Goto ..... 439/79
5,911,605 A 6/1999 Wooldridge et al.
6,102,754 A * 8/2000 Capper et al. ..... 439/857
7,241,190 B2 7/2007 Smyk

OTHER PUBLICATIONS

International Type Search Report from corresponding Swedish Application SE 0600526-8.

* cited by examiner

*Primary Examiner*—Edwin A. Leon
(74) *Attorney, Agent, or Firm*—WRB-IP LLP

(57) ABSTRACT

A contact finger includes a connection member and a contact member. The connection member is connected to one end of a cable, while the contact member is intended for contact with a corresponding contact member on a second contact finger. A transverse, ridge-shaped portion is provided at the front end portion of the contact member. The contact member is moreover provided with a series of grooves for improved contact efficiency. A contact device according to the present invention includes a contact finger in accordance with the above.

16 Claims, 2 Drawing Sheets

CONTACT FINGER WITH GROOVES

TECHNICAL FIELD

The present invention relates to a contact finger comprising a connection member for connection to one end of a cable and a contact member for contact with a corresponding contact member on a second contact finger, a transverse, ridge-shaped portion being provided at the front end of the contact member.

The present invention also relates to a contact device.

BACKGROUND ART

Contact fingers and contact devices in accordance with above are previously known in the art. More precisely, contact devices are previously known in the art in particular for high current strengths, where the contact devices are intended to be connected to the end of a cable for interconnection of one or more cables to one another. The contact devices comprise an outer housing, typically manufactured from plastic, contact fingers for the actual electrical connection, and a metal spring associated with each contact finger in order to generate such a force on each respective contact finger that they, in the connected state, are biased towards one another for maintaining good contact, whereby sparking or undesirable overheating because of a defective contact between the contact fingers is intended to be avoided.

Those parts that are intended to be in direct physical contact with one another moreover display a standardised design so that contact devices from different manufacturers may marry together with one another.

The springing which was mentioned above has thus hitherto been used to realise a good contact between the contact fingers. Certainly, this functions satisfactorily, but at high current strengths it has proved that the springing is not always sufficient to entirely prevent sparking or undesirable overheating. The term "higher current strengths" is taken in this context to signify current strengths that are higher than those for which the contact device in question is classified. At the same time, the stiffness of the metal spring cannot be further increased for a classification for increased current strength while retaining the same physical dimensions, since interconnection and disconnection of the contact devices which, to some degree, take place against the action of the spring, must still be possible. The reason for the defective contact at higher current strengths is thus assumed principally to be insufficient contact pressure or otherwise a far too limited contact surface area.

A further problem is that the contact fingers, when they are connected each to a cable end, can be affected thereby when the contact devices are moved, in particular if the cables are heavy and stiff. In such instance, the contact fingers may slip in relation to one another and in the even of unevenness, play may readily occur between them. Nor is the position of the contact fingers in relation to one another or to the contact housing a matter of absolute certainty.

Another problem may be random and unpredictable unevenness in the material, which may possibly have occurred during manufacture. It may be the contact fingers themselves that are uneven, so that contact only takes place at some individual point instead of along a line, which is intended. Possibly, the contact fingers may flip around such a contact point, at least in the even of insufficient contact pressure, which will give rise to problems involving sparking and undesirable overheating as described above.

The contact springs may also partly contribute to these undesirable properties, in that they do not exactly correspond to the established norms and requirement specifications and, as a result, deliver a spring force which is not uniform throughout the entire width of the contact finger.

While these problems may in principle be circumvented by replacing an existing contact device with a higher classification as regards current strength, this is not often desirable, on the one hand for reasons of space and on the other hand for reasons of cost.

Problem Structure

There is thus one object of the present invention to realise a contact finger and contact device, respectively, where sufficiently good contact is obtained in order to make for use at higher current strengths than has hitherto been possible, at the same time as the outer dimensions of the contact device are maintained unchanged.

Solution

The object forming the basis of the present invention will be attained concerning the contact finger if this is characterised in that the contact member is provided with a series of grooves for improved contact efficiency.

Further advantages will be attained if the contact finger is moreover given one or more of the characterising features as set forth in appended subclaims 2 to 8.

Concerning the contact device, the object of the present invention will be attained if this includes a contact finger in accordance with the foregoing.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

Figure 1:
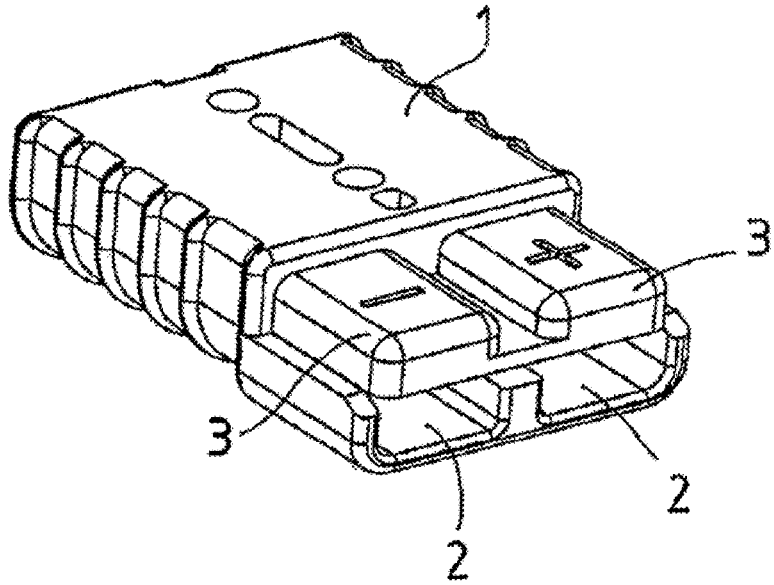
FIG. 1 is a perspective view of a contact housing in which at least one contact finger according to the present invention may be disposed.

FIG. 1 shows the housing 1 for a contact device which includes a contact finger 4 according to the present invention. The housing 1 which is shown in the Figure may include two contact fingers 4 according to the present invention, and these are accessible through the openings 2 in the end of the housing 1 facing towards the observer of the Figure. The housing 1 which is shown in the Figure is to be considered exclusively as an example and the present invention also encompasses contact devices with both a single contact finger and with three or more.

Two identical houses 1 marry together to one another so that the contact fingers 4 in each respective contact device can come into contact with one another. In order for this to be possible, two contact devices must be turned to face towards one another so that the ridges 3 on the one housing 1 fit in the openings 2 on the other, corresponding contact device. The contact devices are identical and must be turned so as to be connected together and it is not physically possible to connect them together incorrectly.

Contact devices of the type illustrated in FIG. 1 have different fields of practical application depending on the current strength for which they are intended, but are often used in applications with relatively high current strengths, typically of the order of between 50 and 600 A depending on size, with voltages of up to 600 V. One example of such a practical field of application is the charging of battery powered electric trucks for indoor use.

Figure 2:
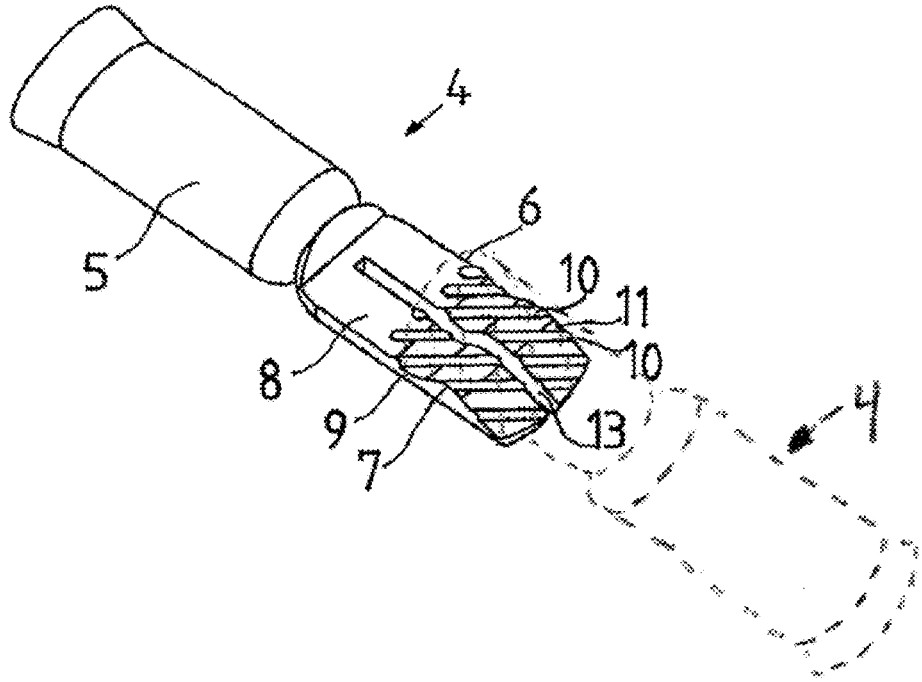
FIG. 2 is a perspective view of one preferred embodiment of the contact finger according to the present invention.

FIG. 2 shows a contact finger 4 according to the present invention. The main parts of the contact finger 4 are a connection member 5 and a contact member 6. The connection member 5 functions for connection to the end of a cable, while the contact member 6 is intended to be in contact with the contact member 6 on a contact finger in that contact device together with which the first contact device is interconnected. The material in the contact finger 4 is preferably a material possessing extremely good conductivity, for example pure copper, pure silver or silver-plated copper. Both of the materials are advantageously surface-treated so as to prevent scratches and oxidation in the surface layer which cold possibly lead to deterioration in contact.

The connection member 5 is, in the preferred embodiment, in the form of a tube which is closed at its inner end, i.e. that end which connects to the contact member 6. On connection of the connection member 5 to a cable, one end, where the insulation has been stripped off a distance slightly less than the length of the connection member 5 is passed into the connection member 5. Thereafter, the connection member 5 is deformed or crimped so that it is fixed and remains in position on the cable.

Figure 3:
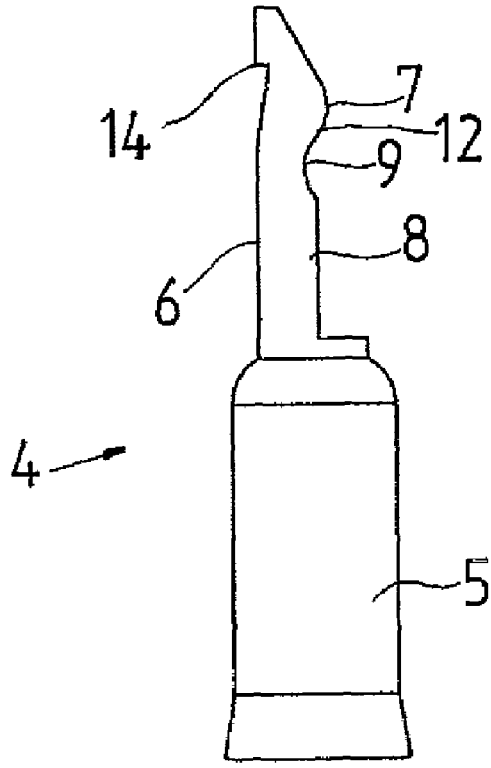
FIG. 3 is a straight side elevation of the contact finger according to FIG. 2.
Figure 4:
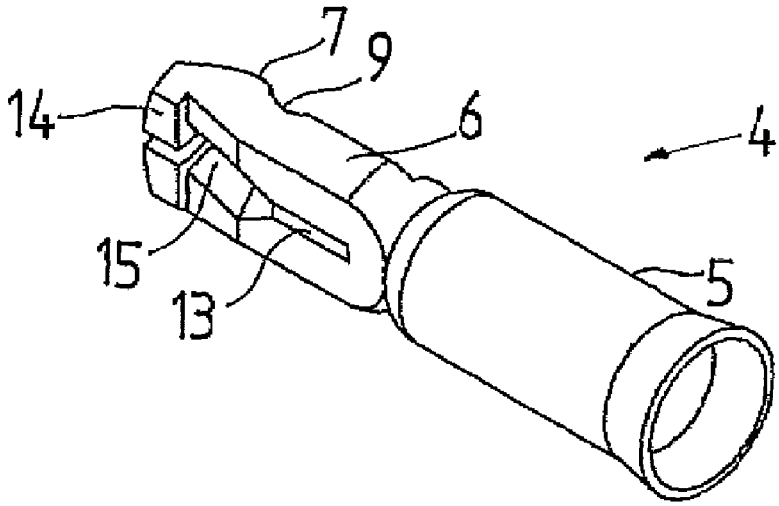
FIG. 4 is a perspective view of the contact finger according to FIGS. 2 and 3 from another angle.

The contact member 6 includes, as is also visible in FIG. 3, a ridge-shaped portion 7 at its outer, front end. The ridge-shaped portion 7 is transverse in relation to the longitudinal direction of the contact finger 4. The ridge-shaped portion 7 on each respective contact finger 4 is to be "passed" by the contact finger 4 in the opposing contact device in order to reach an interconnected position with good contact between the contact fingers 4. In such instance, the two contact fingers 4 are intended to spring away a distance transversely of the direction of movement on the interconnection, from their final interconnected position before this latter may be assumed.

The planar portion 8 is the inner portion of the contact member 6. It is unlikely that this area will be used for direct contact with another contact finger 4 on the interconnection of two contact members, but this portion is also manufactured of the same material and with the same surface treatment as the remainder of the contact finger 4. Between the planar portion 8 and the ridge-shaped portion 7, there is a transverse depression 9 which is not to be found on prior art contact fingers 4. The configuration of the depression 9 is complementary to that of the ridge-shaped portion 7, so that a larger abutment area and configurational engagement will be obtained on the front portion of the contact finger 4.

The front portion of the contact member 6 is grooved with a number of grooves 10. The width of the grooves 10 is equal to or greater than the depth of the grooves 10 in the preferred embodiment. The width of the grooves 10 is substantially of the same order of magnitude as the space 11 between them. The grooves are disposed at an angle to the longitudinal axis of the contact finger. The obliquely inclined grooves 10 will, on an interconnection with a similar contact finger 4, entail that contact between the two contact fingers 4 takes place in a network of contact points, i.e. in those regions where the spaces 11 intersect one another. Even if contact does not take place in the grooves 11, their presence will nevertheless lead to an improved contact and thereby less heat generation. Probably, this is because the pressure in the contact areas has increased, since the total contact area is reduced while the force delivered by the spring means on the contact fingers 4 is substantially constant. The contact between the two contact fingers 4 will thereby be more reliable and the risk of play and sparking is reduced. It is hereby possible to increase the current strength without any simultaneous increase in the generation of heat.

The appearance of the depression 9 is particularly well apparent from FIG. 3. Its profile largely corresponds to the profile of the ridge-shaped portion 7 which is reminiscent of a length of a sinus curve. The profile of the ridge-shaped portion 7 and the profile of the depression 9 are largely complementary to one another, which implies that a contact between them also takes place along the flank 12 in the transition between the ridge-shaped portion 7 and the depression 9. Moreover, abutment takes place not only along a line at the highest point of the ridge-shaped portion 7, but over a larger zone along the bottom and defining surfaces of the depression 9. Contact may possibly not take place over a completely unbroken surface if the grooves 10 are disposed on the contact finger 4, but in such an event the abutment gives an increase of the number of contact points in the network which is formed between the slanting grooves. The flank 12 is, like the ridge-shaped portion 7 and the depression 9, provided with grooves 10 in the preferred embodiment.

The match between the profile of the ridge-shaped portion 7 and the profile of the depression 9 also gives a configurational interlock which is considerably more reliable than has hitherto been possible, and reduces the risk of movement between the two contact fingers 4 and thereby of play or clearance between them, or of unintentional disconnection.

A further distinguishing feature in the contact finger 4 according to the invention is the presence of a longitudinal slot 13 through the contact member 6. This slot 13 provides in itself an effect on the contact efficiency, regardless of whether the contact finger 4 is provided with grooves or not. The reason for this is probably that a material unevenness at a point on one side of the slot 13 need not necessarily entail that play between the contact fingers 4 occurs throughout the entire contact member 6.

In the preferred embodiment, a contact finger 4 is shown with a single slot 13, but variations on this theme are conceivable, such as a contact finger 4 completely without a slot 13, but also with two or even more slots 13.

On that side of the contact member 6 which is turned to face away from the corresponding contact finger 4 and, thus, is not to be in contact with another contact finger 4, there is disposed a heel 14 along the entire width of the contact finger 4. The heel 14 is intended for engagement with the previously mentioned contact spring which entails that the contact fingers 4 are resiliently disposed in the housing 1. Corresponding heels 14 are also disposed on contact fingers of prior art type. In connection with the heel 14, there is, however, a depression or recess 15. The material which has been omitted on the making of the recess 15 is preferably used to widen the contact finger 4 and thereby provide room for a further additional few contact points with substantially the same total quantity of material included.

The depression or recess 15 may also be utilised for a material saving in relation to the prior art contact fingers without any appreciable reduction taking place of the stability of the contact finger 4.

In practical trials with one type of contact device, it has proved that contact fingers according to the present invention have such a low heat generation while in operation that contact devices with such contact fingers have been able to be classified for use in current strengths of up to 225 A, compared with 175 A for a corresponding prior art contact device.

The above-described advantages and the good contact between two contact fingers 4 according to the present invention are attained in ideal conditions, i.e. when two identical contact fingers 4 according to the invention are in contact with one another. However, a satisfactory result will also be attained as regards contact efficiency also when one contact finger 4 according to the present invention is interconnected with a prior art contact finger. Probably, performance would lie somewhere between the performance for two prior art contact fingers and two contact fingers 4 according to the present invention. However, care should be taken to ensure that the contact efficiency is not overestimated, but the point of departure should be that the highest permitted current strength is the lowest of those disclosed for contact devices according to the new and prior art technologies, respectively. Interconnection of contact devices of different classifications is in general not permitted for reasons of safety and, as a result, it is possible to provide contact devices with different mechanical obstacles against interconnection, such as locking devices which only permit the interconnection between identical contact devices.

DESCRIPTION OF ALTERNATIVE EMBODIMENTS

The present invention may be varied in a number of different respects without to that end deviating from the inventive concept as herein disclosed. For example, the width, depth, density and cross sectional profile of the grooves may be different from those shown on the Drawings and described above.

In the preferred embodiment, the contact fingers have been described as having both grooves 10 and a cross-sectional profile which consists of a ridge 7 and a depression 9. It is fully possible to provide a contact finger with only two of these characterising features, i.e. to provide a contact finger of conventional cross-sectional profile with grooves, or alternatively to provide a smooth contact finger with the cross-sectional profile according to the present invention.

Another method of varying the invention is to cause the ridge-shaped portion 7 and the depression 9 to change places, i.e. to position the depression 9 outermost on the front portion of the contact finger 4 and the ridge-shaped portion 7 inside it. By such means, there will be realised a substantially equally large contact area as in the preferred embodiment. Possibly, protection against unintentional disconnection may be slightly poorer, since the ridge-shaped portions 7 do not pass each other on interconnection.

Yet another method of varying the present invention is to cause the grooves to intersect one another on one and the same contact finger 4 so that a diamond pattern is formed throughout the entire or parts of the grooved area. When two such contact fingers are interconnected, the two diamond networks will together form yet a further diamond network which, in most cases, is "denser" than each one of the diamond networks individually, with a large number of contact points.

As was mentioned above, it is also possible to vary the number of slots or incisions 13 in the contact member 6 and also their length.

The present invention may be varied further without departing from the scope of the appended Claims.

What is claimed is:

1. A contact finger comprising a connection member for connection to one end of a cable and a contact member adapted to connect with a corresponding contact member on a second contact finger, a transverse, ridge-shaped portion being provided at a front end portion of the contact member, the contact member being provided with a series of grooves in a contact surface thereof, the ridge-shaped portion being provided in the contact surface and the grooves extending over at least the ridge-shaped portion, a direction from an open end to a closed end of the grooves being generally perpendicular to a longitudinal direction of the finger.

2. The contact finger as claimed in claim 1, wherein the grooves are disposed in two or more series of mutually aligned grooves, the series at least partly overlapping one another so that a diamond pattern is formed.

3. The contact finger as claimed in claim 1, wherein the grooves are slanted so that they are angled in relation to the longitudinal axis of the contact finger.

4. The contact finger as claimed in claim 1, wherein a transverse depression whose configuration is complementary to the ridge-shaped portion is disposed in association with the ridge-shaped portion the ridge-shaped portion on one contact finger being insertable in the depression on a corresponding contact finger and vice versa.

5. The contact finger as claimed in claim 1, wherein a recess is provided on a side of the contact member which is opposed to the ridge-shaped portion.

6. The contact finger as claimed in claim 1, wherein at least one longitudinal slot divides the contact member in its longitudinal direction.

7. The contact finger as claimed in claim 1, wherein the connection member is tubular.

8. A contact device comprising at least one contact finger as claimed in claim 1.

9. The contact finger as claimed in claim 1, wherein the contact member is adapted to connect directly to an identical contact member on the second contact finger.

10. The contact finger as claimed in claim 1, wherein the grooves are provided on only a single surface of the contact member.

11. The contact finger as claimed in claim 1, wherein all of the grooves extend through less than an entire thickness of the contact member.

12. The contact finger as claimed in claim 1, wherein the grooves are adapted to facilitate contact efficiency between the contact member and the corresponding contact member.

13. The contact finger as claimed in claim 1, wherein the grooves are superficial grooves.

14. The contact finger as claimed in claim 1, wherein the grooves are closed grooves.

15. A contact device comprising a pair of substantially identical contact fingers, each contact finger comprising a connection member for connection to one end of a cable and a contact member adapted to connect with a corresponding contact member on the other contact finger when the other contact finger is rotated 180° about a longitudinal axis of the other contact finger and rotated 180° about a transverse axis of the other contact finger perpendicular to the longitudinal axis, a transverse, ridge-shaped portion being provided at a front end portion of the contact member, the contact member being provided with a series of grooves in a contact surface thereof, the ridge-shaped portion being provided in the contact surface and the grooves extending over at least the ridge-shaped portion, a direction from an open end to a closed end of the grooves being generally perpendicular to a longitudinal direction of the finger, wherein the ridge-shaped portions of each contact finger contact each other when the contact members on the pair of contact fingers are connected.

16. The contact device as set forth in claim 15, wherein the grooves on each contact surface extend at an angle to a longitudinal axis of the contact finger so that, when the contact members on the pair of contact fingers are connected, the grooves on contacting contact surfaces define a plurality of diamond-shaped contact areas.

* * * * *